United States Patent [19]

Sue

[11] 4,131,274

[45] Dec. 26, 1978

[54] SHEET FEED CASSETTE

[75] Inventor: Takaji Sue, Kawasaki, Japan

[73] Assignee: Ricoh Company, Ltd., Tokyo, Japan

[21] Appl. No.: 748,757

[22] Filed: Dec. 8, 1976

[30] Foreign Application Priority Data

Dec. 15, 1975 [JP] Japan ..... 50/149900

[51] Int. Cl.[2] ..... B65H 1/28; B65H 3/44; B65H 3/56

[52] U.S. Cl. ..... 271/9; 271/127; 271/164; 271/170

[58] Field of Search ..... 271/164, 162, 170, 171, 271/9, 117, 127

[56] References Cited

U.S. PATENT DOCUMENTS

| | | | |
|---|---|---|---|
| 3,273,883 | 9/1966 | Baronnie | 271/9 |
| 3,288,460 | 11/1966 | Eichorn | 271/170 X |
| 3,588,106 | 6/1971 | Csaba et al. | 271/170 |
| 3,907,283 | 9/1975 | Miller | 271/164 X |
| 3,989,236 | 11/1976 | Komori et al. | 271/9 X |
| 4,025,066 | 5/1977 | Sue | 271/9 |
| 4,061,328 | 12/1977 | Fujimoto et al. | 271/9 X |

FOREIGN PATENT DOCUMENTS

| | | | |
|---|---|---|---|
| 2446015 | 4/1975 | Fed. Rep. of Germany | 271/9 |

*Primary Examiner*—Bruce H. Stoner, Jr.
*Attorney, Agent, or Firm*—Cooper, Dunham, Clark, Griffin & Moran

[57] ABSTRACT

A sheet feed cassette includes a tray having a pair of corner claws which assume a raised position in the non-feed position of the tray and which move down from the raised position when the tray is placed in its feed position. A receptacle is provided for slidably supporting the sheet tray, and includes a guide member having formed therewith notches which are located opposite to the corner claws. The corner claws have projections which are guided by the guide member, thereby controlling the vertical movement of the corner claws in dependence upon the relative position between the projections and the guide member.

1 Claim, 11 Drawing Figures

SHEET FEED CASSETTE

BACKGROUND OF THE INVENTION

The invention relates to a sheet feed tray for use in a facsimile transceiver or copying machine, and more particularly to a sheet feed tray for containing a stack of sheets which are fed into the facsimile transceiver or copying machine.

In equipment such as a facsimile transceiver or copying machine which is provided with a sheet feed mechanism for supplying an original sheet or record sheet, a sheet feed cassette is in widespread use to simplify the loading and storage of sheets and to improve the functioning of the equipment. The cassette serves as both a sheet container and a sheet receptacle. The cassette is usually provided with corner claws for feeding sheets separated one by one, and the corner claws must be moved to their inoperative position when loading sheets onto the cassette. It is difficult to perform such a moving operation of the corner claws while the cassette is mounted on the equipment such as a facsimile transceiver, for example, so that the loading of sheets on the cassette has generally been performed by removing the cassette from the equipment.

On the other hand, it is often necessary to provide a number of sheet feed cassettes which are equal in number to the kind of sheets used. By way of example, a facsimile transceiver employs both an original to be transmitted and a record sheet for reception, which must be alternately changed as the operation of the transceiver switches between a transmit mode and a receive mode. To eliminate such troublesome operation, there has been proposed an arrangement including a plurality of sheet feed cassettes containing individual sheets of different kinds and which permits a selective use of either one of the cassettes. However, there must then be provided a feed mechanism devoted to the individual cassettes as well as a cassette selection mechanism, resulting in a complex and bulky arrangement.

There has also been proposed a dual cassette comprising upper and lower cassette portions each capable of containing a different kind of sheets so that a single feed mechanism may be operated to selectively feed either sheet. While this cassette has the advantage of an integral structure, the construction of the cassettes themselves becomes complex and the loading of the sheets onto the lower cassette portion cannot be easily achieved, thereby degrading the maneuverability of the equipment.

SUMMARY OF THE INVENTION

A sheet feed cassette according to the invention includes a sheet tray having a pair of movable corner claws which in the feed position descend to retain the opposite corners of the leading end of the stack of sheets, and which in the non-feed position move upward away from the sheets placed on the tray or from the sheet receiving surface of the tray, thereby enabling a rapid and facilitated loading of sheets. The cassette according to the invention can be constructed as a dual type including upper and lower trays each capable of containing sheets of a different size or kind. This can be achieved without resulting in a complex construction of the cassette itself or without making the loading of sheets onto either tray difficult to perform.

Therefore, it is an object of the invention to provide a sheet feed cassette including a sheet tray having a pair of corner claws which can be raised from their lower position in response to a movement of the tray from its feed to its non-feed position, without requiring a separate manual intervention to move the corner claws upwardly, when it is desired to load sheets onto the tray.

It is another object of the invention to provide a sheet feed cassette which includes upper and lower trays each having a pair of corner claws which may be vertically moved in response to a movement of either sheet tray portion.

DETAILED DESCRIPTION OF PREFERRED EMBODIMENTS

Figure 1:
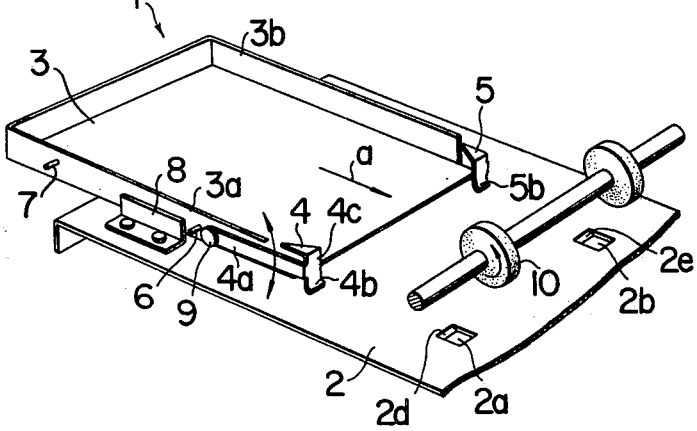
FIG. 1 is a perspective view of the sheet feed cassette according to the invention as mounted on a cassette receptacle, the cassette assuming a non-feed position.

Referring to FIG. 1, there is shown a sheet feed cassette 1 which is constructed in accordance with the invention. The cassette 1 is shown mounted on a sheet tray receptacle 2 which is located in the sheet feed station of a facsimile transceiver, for example.

The cassette 1 comprises a sheet tray 3 for placement of sheets thereon, a pair of corner claws 4, 5 which are mounted on the sideplates 3*a*, 3*b* of the tray, and a pair of stops 6, 7 fixedly mounted on the sideplates 3*a*, 3*b* so as to extend outwardly therefrom (the stops on the sideplate 3*b* being not shown). The cassette 1 is disposed on the receptacle 2 between a pair of tray guides 8 (only one being shown) fixedly mounted thereon so as to be slidable through a distance corresponding to the spacing between the stops 6 and 7.

The corner claws 4, 5 are located at the opposite corners of the front end of the sheet tray 3, and are formed on the free ends of support arms 4*a*, 5*a* (the support arm 5*a* for the corner claw 5 is not shown, it being understood that its construction is quite similar to that for the corner claw 4). The support arm 4*a* has its other end pivotally mounted on a pin 9 which is fixedly mounted on the sideplate 3*a*, and hence its free end is free to move in a vertical plane. At its front end, the corner claw 4 is formed with a transversely extending front plate 4c against which the leading edges of the sheets bear, with the lower end of the front plate 4c being formed with a downwardly depending portion 4b. Claw 5 is similarly formed. In the non-feed position of the cassette 1 as shown in FIG. 2, the depending portions 4b, 5b abut against the upper surface 2c of the receptacle 2, which also serves as a guide member for the corner claws, thereby causing the support arms 4a, 5a to maintain the corner claws 4, 5 away from the sheet receiving surface of the tray 3.

The receptacle 2 is formed with a pair of slots 2a, 2b, which are located opposite the positions assumed by the projections 4b, 5b in the feed position of the cassette 1, thereby allowing the projections to extend therethrough. A feed roller 10 is disposed above the receptacle 2 at a position corresponding to the front end of the cassette 1 in its feed position, and is adapted to move down onto the sheets placed on the cassette when a sheet feeding operation is to take place. The roller 10 is driven by drive means, not shown, for rotation in a direction indicated by an arrow.

Figure 2:
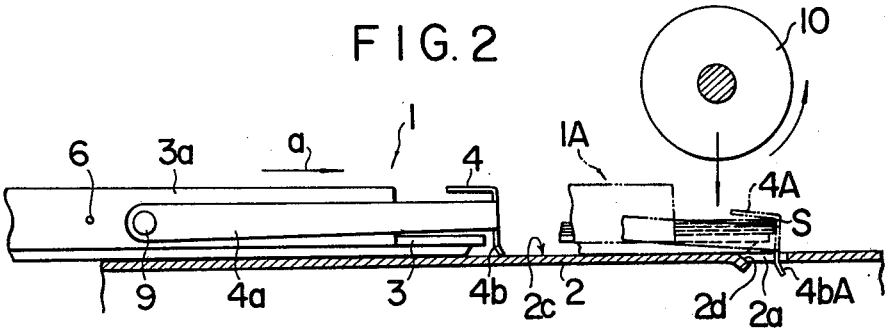
FIG. 2 is a side elevation of a front portion of the cassette as it moves from its non-feed to its feed position.

In use, the cassette 1 is placed in its non-feed position shown in solid line in FIG. 2. Originals to be transmitted, for example, are placed on the tray 3 with their leading ends disposed below the corner claws 4, 5, and then the cassette 1 is moved in the direction of an arrow *a* until it reaches a feed position shown at 1A. The cassette is held stationary at this position by the abutment of the stops 7 against the tray guides 8, which therefore act as stops. As the cassette 1 moves from its non-feed to its feed position, projections 4b, 5b of the corner claws 4, 5 are dragged along the receptacle 2, but fall down into the slots 2a, 2b as shown at 4bA in FIG. 2 when the cassette reaches its feed position. In this manner, the corner claws move down as shown at 4A to retain the opposite corners of the leading ends of originals S placed on the tray. When a feed button, not shown, is actuated, the feed roller 10 moves down to engage the stack of originals, thereby feeding them one by one to the right, as viewed in this Figure.

When all of the originals S to be transmitted are fed or when new originals are to be loaded, the cassette 1 is moved in the opposite direction from its feed to its non-feed position, whereby the projections 4b, 5b move out of the slots 2a, 2b and bear against the upper surface of the receptacle 2, thus raising the corner claws to their upper position. To facilitate the movement of the projections 4b, 5b into and out of the slots 2a, 2b, it will be noted that these projections as well as one side edge 2d, 2e of the slots are slanted.

Figure 3:
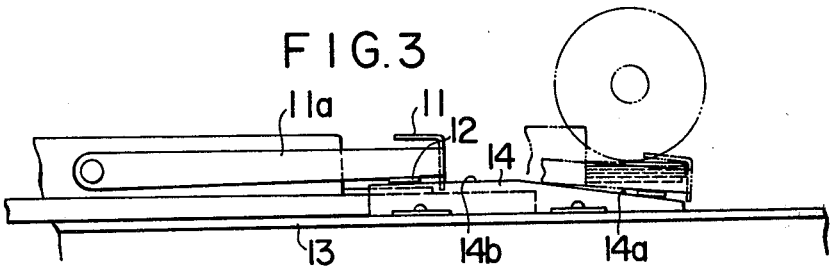
FIG. 3 is a side elevation of the front portion of the cassette constructed in accordance with another embodiment of the invention.
Figure 4:
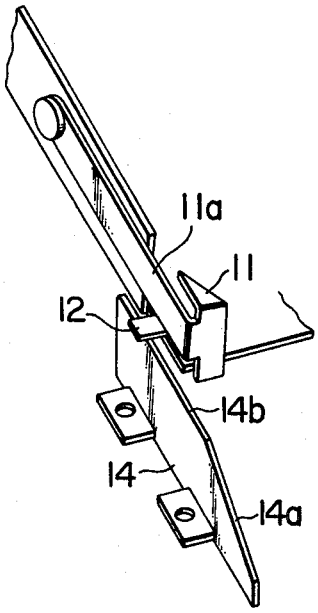
FIG. 4 is a perspective view of part of the embodiment shown in FIG. 3.

FIGS. 3 and 4 illustrate alternate means for raising the corner claws. Specifically, a corner claw 11 of an identical pair (only one being shown) is supported by a support arm 11a, which is formed with an outwardly extending folded piece 12 adjacent the corner claw, and a guide member 14 is fixedly mounted on a receptacle 13 in general alignment with the folded piece 12. The guide member 14 extends across the non-feed and the feed position of the cassette, with its upper edge being slanted toward the feed position. The folded piece 12 is placed in bearing engagement with the upper edge of the guide member 14, and engages a raised portion 14b thereof in the non-feed position of the cassette as shown in solid line in FIG. 3, thereby maintaining the corner separator 11 in its raised position. When the cassette is moved to its feed position shown in phantom line, the folded piece 12 slides along the upper edge of the guide member 14, descending along a slanted portion 14a thereof. As a consequence, in the feed position of the cassette, the corner claw 11 is effective to retain the sheets placed on the tray. When the cassette is retracted from the feed position, the folded piece 12 is raised by moving along the slanted portion 14a, thereby raising the corner claw 11. In the described embodiments, the corner claws 4, 5 or 11 act to retain the sheets such as originals by the weight of the corner claws themselves as well as the associated support arms. However, alternatively, the corner claws may be forcedly urged in a direction to retain the sheets.

The sheet feed cassette according to the invention can be constructed as a dual type. Before describing the construction of such cassette in detail, the general arrangement will be described with reference to FIG. 5. The cassette includes a first sheet tray T1 capable of receiving a plurality of first sheets S1 in a stack thereon and a second sheet tray T2 capable of receiving a plurality of second sheets S2 in a stack thereon, the trays being disposed one above the other. The first or upper tray T1 is mounted to be slidable and rotatable relative to the lower second tray T2. The second tray T2 is fixedly mounted on a body D of the equipment such as a facsimile transceiver, at a home position in which the leading end of the sheets S2 on the tray T2 are located below feed roller F mounted on the body D. A sliding movement of the first tray T1 in the direction of an arrow b over the second tray T2 causes the sheets S1 placed thereon to be located in its home position in which the leading ends of the sheets S1 are located below the feed roller F. Each of the trays T1 and T2 is provided with a pair of corner claws on its forward end, which will be specifically described later.

Figure 5:
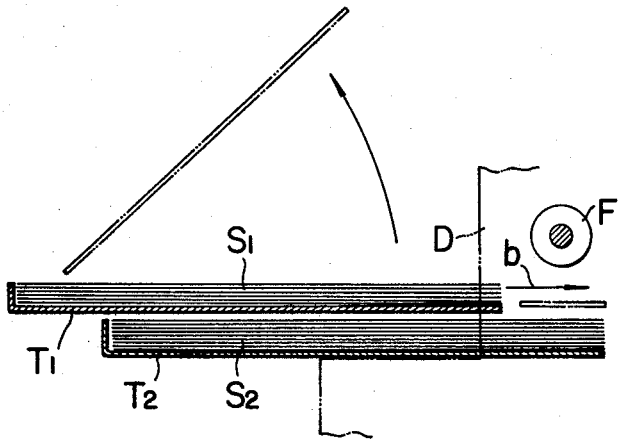
FIG. 5 is a schematic side elevation of the sheet feed cassette of dual type which is constructed in accordance with a further embodiment of the invention.
Figure 7:
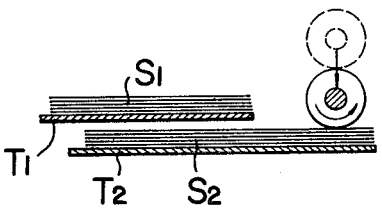
FIG. 7 is a schematic side elevation of another example of feed mechanism.
Figure 6:
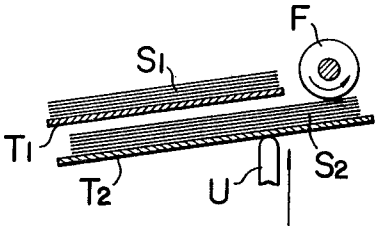
FIG. 6 is a schematic illustration of one example of a feed mechanism.

FIG. 6 shows a feed mechanism which cooperates with the cassette shown in FIG. 5. Specifically, the mechanism includes a raising lever U which selectively pushes either tray T1 or T2 upwardly until the leading end of the sheets S1 or sheets S2 bears against the feed roller F, which assumes a fixed position in this arrangement. FIG. 7 shows an alternative arrangement in which the feed roller F is made movable so as to be selectively engageable with the leading ends of the sheets S1 or S2 on the respective trays T1, T2. In the description to follow, it is assumed that the dual type cassette of the invention is used in a facsimile transceiver having a feed mechanism of the type shown in FIG. 6.

Figure 8:
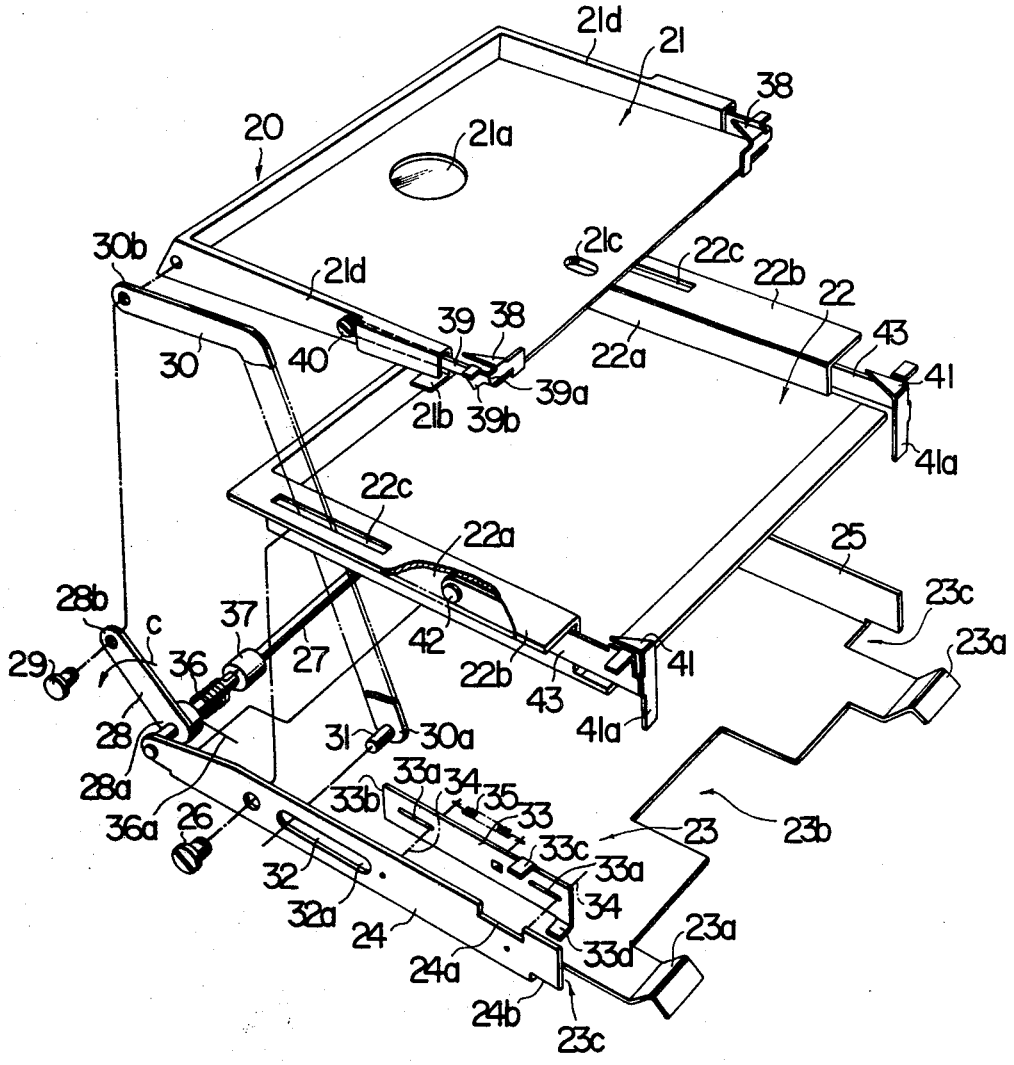
FIG. 8 is an exploded, perspective view of the sheet feed cassette of dual type.

Referring to FIG. 8, there is shown a dual type cassette 20 in an exploded perspective view. The cassette 20 essentially comprises a first sheet tray 21 (corresponding to the tray T1 shown in FIG. 5) which is adapted to receive originals to be transmitted thereon, corresponding to the first sheets S1, a second sheet tray 22 (corresponding to the tray T2 shown in FIG. 5) adapted to receive record sheets corresponding to the second sheets S2 thereon, and a cassette frame 23 which supports both trays.

The second tray 22 is pivotally mounted on the frame 23 by setscrews 26 (only one being shown) which extend through openings formed in the sideplates 24, 25 of the frame 23 and engage the opposite sides of the tray 22 adjacent its rear end. A stay 27 is rotatably connected between the rear ends of the sideplates 24, 25 and a pair of support arms 28 (only one being shown) for the first tray 21 have their ends 28a fixedly connected with the opposite ends of the stay 27. The other ends 28b of the support arms 28 are rotatably connected with the opposite sides of the first tray 21 adjacent the rear end thereof, by means of setscrews 29 (only one being shown), whereby the tray 21 is swingable relative to both the cassette frame 23 and the second tray 22. A pair of inverted L-shaped arms 30 (only one being shown) also have their ends **30*b* pivotally connected with the opposite sides of the first tray 21, by means of the setscrews 29. The other ends of the arms 30 extend through elongate slots 22*c* formed in a pair of guide members 22*b* which are formed as L-shaped extensions from the upper end of opposite sideplates 22*a* of the second try 22, thus extending along the opposite sides of the second tray 22. At their other ends 30*a*, the arms 30 have pins 31 fixedly mounted thereon, which pins extend through a pair of elongate guide slots 32 (only one being shown) formed in the sideplates 24, 25 of the cassette frame 23, thus extending externally of these sideplates (see FIG. 9). The arms 30, pins 31, and elongate guide slots 32 constitute together a stop means for maintaining the first tray 21** in its feed positiion.

A sliding plate 33 is slidably mounted on one sideplate 24, by having a pair of spaced elongate slots **33*a* formed therein loosely engaged by a pair of guide pins 34 fixedly mounted on and extending inwardly from the sideplate 24. The sliding plate 33 is normally urged by a tension spring 35, extending between the sliding plate and one of the guide pins 34, in a direction toward the rear end of the sideplate 24. Under this condition, the rear end 33*b* of the sliding plate 33 is located to register with a forward end portion 32*a* of the slot 32 (see FIG. 9). Adjacent its forward end, the sliding plate 33 is formed with a pair of lengthwise and vertically spaced folded pieces 33*c*, 33*d*, which extend through notches 24*a*, 24*b* formed in the upper and lower edges of the sideplate 24** to the outside thereof.

Figure 9:
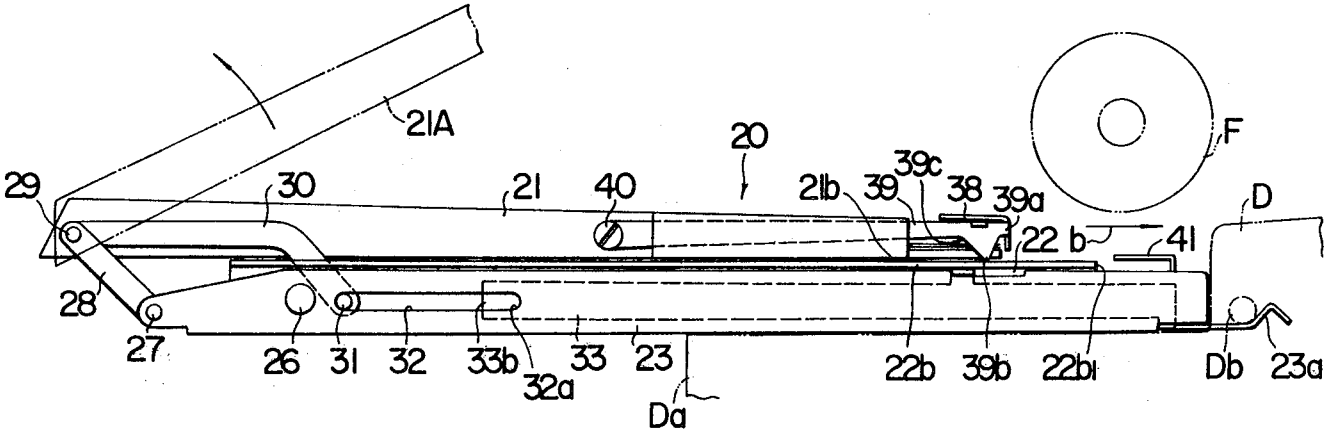
FIG. 9 is a side elevation of the cassette shown in FIG. 8 when the upper tray assumes its non-feed position.

A helical spring 36 is disposed on the stay 27 and has one end secured to a collar 37 fixedly mounted on the stay 27 and its other end **36*a* resiliently engaged with the rear edge of the cassette frame 23. The resilience of the spring 36 causes the stay 27 and the support arms 28 to rotate in a direction indicated by an arrow c, thus urging the first tray 21 to move rearwardly relative to the second tray 22. A sight window 21*a* is formed substantially centrally in the first tray 21 for permitting an observation of the presence or absence of record sheets on the second tray 22. Adjacent the front end, the bottom of the first tray 21 is provided with a pair of tongues 21*b* (only one being shown) which cause the tray 21 to move along the guide member 22*b* when the tray 21 is moved relative to the second tray 22. A recess or slot 21*c* is formed centrally in the first tray 21 adjacent its front end for cooperation with a detector, not shown, which operates to detect the presence or absence of originals to be transmitted on the tray 21. The first tray 21 has a pair of opposite sideplates 21*d*, 21*d*, and a pair of corner claws 38 are integrally formed on the free ends 39*a* of support arms 39, which are pivotally mounted on the outside of the sideplates 21*d*, 21*d* by means of setscrews 40 (only one being shown). The corner claws 38 are located at the opposite corners of the front end of the first tray 21, and are urged by their own weight to move down about the setscrews 40, or in a direction to retain the sheets placed on the tray 21. Instead of relying on the weight of the corner claws 38 and their support arms 39, springs, not shown, may be disposed on the setscrews 40 with their respective ends engaged with the respective sideplates 21*d*, 21*d* and their other ends engaged with the support arms 39, thereby urging the support arms 39 to rock in the same direction. Since "original" carriers may be used depending on the paper quality of the originals to be trnsmitted which are placed on the first tray 21, the use of a forced bias urging the corner claws 38 to move down is preferred. Adjacent the free ends 39*a*, the support arms 39 are formed with downwardly depending projections 39*b* along their lower edges. As shown in FIG. 9, each of the projections 39*b* has a slanted rear edge 39*c***.

A pair of corner claws 41 are disposed at the opposite corners of the front end of the second tray 22, and are integrally formed on the free ends of support arms 43, which are pivotally mounted on the sideplates **22*a* by means of setscrews 42 (only one being shown). These corner claws are urged to move downward in a similar manner to the corner claws 38. The corner claws 41 have downwardly depending portions 41*a*, which are located within notches 23*c*, formed in the front end of the cassette frame 23 along its opposite sides. At its front end, the cassette frame 23 is formed with a pair of cassette locating arms 23*a*, 23*a* of an inverted L-configuration for locating the cassette 20 in position on the sheet feed station of the facsimile transceiver. The frame is also centrally formed with a notch 23*b*** which is operatively associated with a tray raising lever to be described later.

As shown in FIG. 9, the cassette 20 is placed on a cassette receiving portion DA of the facsimile transceiver, and then the cassette frame 23 is pushed in the direction of the arrow b, whereupon the cassette locating arms **23*a* engage detent members Db formed in the sheet feed station of the body D for holding the cassette in position. When the cassette 20 is held in position, the leading ends of record sheets (not shown) placed on the second tray 22 are located below the feed roller F, and the second tray 22 assumes its feed position, which will be hereinafter referred to as a "receive mode". The second tray 22 is maintained in this feed position regardless of whether record sheets placed thereon are or are not to be fed therefrom. As shown in FIG. 9, when the cassette 20 assumes the feed position, the first tray 21 is urged rearwardly of the second tray 22. In other words, the first tray 21** assumes its non-feed position in which the leading end of sheets placed thereon is retracted from a position directly below the feed roller F.

In the non-feed position of the first tray 21, the downwardly depending projections **39*b* bear against the upper surfaces of the guide members 22*b* formed on the second tray 22, whereby the tray assumes a counterclockwise rocked position and the corner claws 38 on the front ends 39*a* of the support arms 39 assume a raised position away from the sheet receiving surface of the tray against the bias applied thereto. As a consequence, in the receive mode shown in FIG. 9, it is a simple matter to load originals to be transmitted on the tray 21 since the corner claws 38** assume their raised position away from the tray.

When record sheets are to be loaded on the second tray 22, the first tray 21 is rotated counterclockwise about the setscrews 29 as shown by phantom lines at 21A in FIG. 9, thus opening the sheet receiving surface of the second tray 22.

Figure 10:
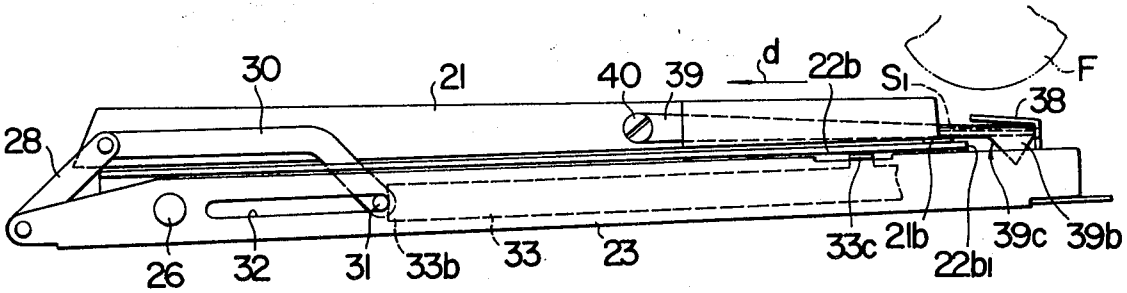
FIG. 10 is a side elevation of the cassette shown in FIG. 8 when the upper tray assumes its feed position.

When the originals to be transmitted which are placed on the first tray 21 are fed into the body D, the tray 21 is moved over the second tray 22 in the direction of the arrow b against the bias applied thereto. At this time, the front end of the tray 21 moves forward while the tongues 21b and the projections 39b slide along the upper surface of the guide members 22b. When the projections 39b fall into notches 22b1 formed in the front end of the guide members 22b, the support arms 39 rock under the bias, thus lowering the corner claws 38 to retain the opposite corners of the leading ends of the originals S1 to be transmitted, as shown in FIG. 10. When the projections 39b fall into the notches 22b1, the tongues 21b still bear against the upper surface of the guide members 22b, thereby supporting the tray 21.

During the sliding movement of the first tray 21, its rear end moves upward and then moves down while causing an oscillation of the support arms 28. The resulting oscillation of the support arms 28 is effective to control the stroke through which the first tray 21 slides. When the opposite corners of the sheets are retained by the corner claws 38, the originals S1 reach the feed position where their leading ends are disposed directly below the feed roller F (see FIG. 10). The position shown in FIG. 10 will be hereinafter referred to as a "transmit mode".

During the sliding movement of the first tray 21 mentioned above, the arms 30 which are pivotally connected with the rear end thereof follow the sliding movement of the tray while maintaining the engagement between their pins 31 and guide slots 32. The resulting movement of the left pin 31 causes the sliding plate 33 to move, against its bias, from the position in which its rear end 33b is registered with the front end portion 32a of the slot 32. In the position of FIG. 10, the pin 31 is locked and held by a first tray positioning mechanism, not shown. As the sliding plate 33 is pushed by the pin 31, the pair of upper and lower folded pieces 33c, 33d formed thereon adjacent the front end thereof operate on a transmit/receive mode switching mechanism, thus establishing a transmit mode of the facsimile transceiver.

Figure 11:
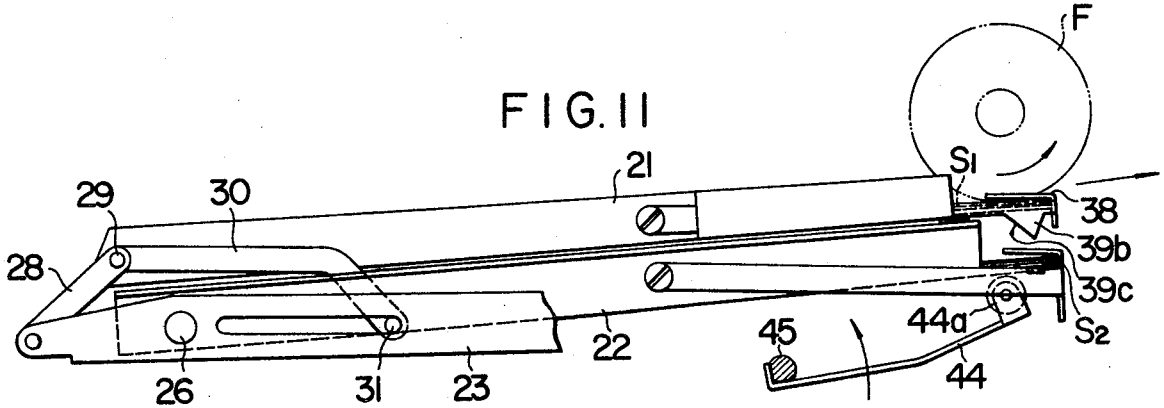
FIG. 11 is a side elevation of the cassette shown in FIG. 8 when the upper tray cooperates with the feed mechanism.

In the transmit mode shown in FIG. 10, when a transmit button, not shown, is depressed, a cassette raising lever 44 rotates counterclockwise about a shaft 45, whereby a roller 44a carried on the free end thereof extends through the notch 23b formed in the front end of the cassette frame 23 into abutment against the lower surface of the second tray 22 at its front end, thus angularly moving the trays 22 and 21 about their pivots or setscrews 26, 29, respectively, in the counterclockwise direction to bring the leading end of the uppermost original S1 to be transmitted, into abutment against the feed roller F (see FIG. 11). The feed roller F rotates in the direction of the arrow when the transmit button is depressed, thus cooperating with the corner claws 38 to feed the uppermost original to be transmitted, toward the body D.

When it is desired to feed a stack of originals to be transmitted, which are placed on the first tray 21, in succession, a continued feeding is achieved by a multi-transmit mechanism, not shown, which operates in response to the detector, not shown, which is located adjacent the recess 21c centrally formed in the front portion of the first tray 21 for detecting the presence or absence of an original or originals to be transmitted.

When the transmission of a single original or a plurality of originals is completed, an ejector, not shown, operates to release the pin 31 from the above mentioned first tray positioning mechanism, whereupon the raising lever 44 is turned clockwise to permit the front portion of the first and second trays 21, 22 to move down from their raised position shown in FIG. 11 to the position shown in FIG. 10. When the pin 31 is released, the first tray 21 moves backward in the direction of an arrow d shown in FIG. 10 over the second tray 22 under its bias until it reaches the non-feed position illustrated in FIG. 9, thus returning the cassette 20 to the receive mode.

When the first tray 21 slides in the direction of the arrow d, the projections 39b of the corner claws which have been trapped in the notches 22b1 formed in the guide members 22b move backward while their slanted rear edges 39c slide along the edge of the notches. As a consequence, the support arms 39 rotate counterclockwise about the setscrews 40 to raise the corner claws 38 formed on their free ends away from a stack of the originals or the tray (see FIG. 9).

During the receive mode shown in FIG. 9, when a receive instruction is issued to the body D, the raising lever 44 is rotated counterclockwise, swinging both the first and second sheet trays to bring a stack of record sheets S2 placed on the second sheeet tray 22 into abutment with the feed roller F for purpose of feeding these sheets as separated from each other.

In the embodiment shown, means in the form of downwardly depending projections for causing a vertical displacement of the corner claws between the feed and the non-feed position of the tray to permit the sheet to be retained or to be freed has been provided only on the first tray 21. However, corner claws functioning in the same manner may also be provided on the lower or second sheet tray 22 in a feed mechanism of the type in which the feed roller F moves up and down as illustrated in FIG. 7. The provision of upper and lower sheet trays which are both slidable and rotatable relative to each other permits a rapid and facilitated loading and feeding of different kinds of sheets.

What is claimed is:

1. A sheet feed cassette apparatus comprising:

a first sheet tray for receiving a stack of first sheets thereon;

a first pair of vertically movable corner claws disposed adjacent the front end of the first sheet tray along the opposite sides thereof and urged in a direction to retain the opposite corners of the leading end of a stack of the first sheets placed on the first tray;

respective projections operatively integral with each of the first corner claws;

a second sheet tray disposed below the first tray for receiving a stack of second sheets thereon;

a second pair of vertically movable corner claws disposed adjacent the front end of the second tray along the opposite sides thereof and urged in a direction to retain the opposite corners of the leading end of a stack of the second sheets placed on the second tray;

guide means formed on the opposite sides of the second tray for slidably carrying the first tray between a feed position and a non-feed position, the guide means being effective to guide the projections in a manner such that the first pair of corner claws associated with the first tray assume a lowered position when the first tray is in its feed position and assume a raised position when the first tray is retracted to its non-feed position;

a cassette frame for supporting the first and second sheet trays; and means for pivotably mounting the first tray on the cassette frame comprising a pair of support arms each having one of its ends pivotally connected with the rear end of the cassette frame and the other of its ends pivotally connected with the rear end of the first tray.

* * * * *